US010994249B1

(12) United States Patent
Mao et al.

(10) Patent No.: US 10,994,249 B1
(45) Date of Patent: May 4, 2021

(54) ANTI-AGGLOMERATION DEVICE USING ULTRASONIC WAVES FOR A NANOFLUID

(71) Applicant: CHANGSHA UNIVERSITY OF SCIENCE AND TECHNOLOGY, Hunan (CN)

(72) Inventors: Cong Mao, Hunan (CN); Zhikang Zhang, Hunan (CN); Yongle Hu, Hunan (CN); Jian Zhang, Hunan (CN); Mingjun Zhang, Hunan (CN); Kun Tang, Hunan (CN); Weidong Tang, Hunan (CN); Linfeng Xiao, Hunan (CN)

(73) Assignee: Changsha University of Science and Technology, Changsha (CN)

( * ) Notice: Subject to any disclaimer, the term of this patent is extended or adjusted under 35 U.S.C. 154(b) by 0 days.

(21) Appl. No.: 17/088,058

(22) Filed: Nov. 3, 2020

Related U.S. Application Data

(63) Continuation of application No. PCT/CN2019/110845, filed on Oct. 12, 2019.

(30) Foreign Application Priority Data

Jun. 3, 2019 (CN) ..... 20191047925.2

(51) Int. Cl.
*B01F 3/12* (2006.01)
*B01F 11/02* (2006.01)
(Continued)

(52) U.S. Cl.
CPC ..... *B01F 3/1242* (2013.01); *B01F 11/0291* (2013.01); *B01F 11/0097* (2013.01); *B01F 13/0008* (2013.01)

(58) Field of Classification Search
CPC ... B01J 19/10; B01L 9/06; G01N 1/28; C12Q 1/6806; C12Q 2523/301; B06B 3/00;
(Continued)

(56) References Cited

U.S. PATENT DOCUMENTS 2,657,668 A * 11/1953 Maier ..... B01J 19/10
2016/0121279 A1* 5/2016 Kim ..... B01F 5/10 366/108
2019/0143292 A1* 5/2019 Alizadeh ..... B01F 11/0283

FOREIGN PATENT DOCUMENTS

CN 204469632 U 7/2015
CN 205570228 U 9/2016
(Continued)

*Primary Examiner* — Charles Cooley

(57) ABSTRACT

An anti-agglomeration device for a nanofluid includes a support module, a motion module, a photoacoustic conversion module and a control module. The support module includes a frame and screws and is configured to support the photoacoustic conversion module and the motion module. The photoacoustic conversion module includes a nanosecond laser, a first clamp, a lens, a silica optical fiber, a second clamp, gold nanoparticles and a container and is configured to realize photoacoustic conversion to generate ultrasonic waves. The motion module includes a servo motor, a dovetailed rail, a guide screw, a fixed plate, a slider and a deep groove ball bearing. The motion module is configured to support the photoacoustic conversion module and realize the combined motions of the photoacoustic conversion module. The control module includes a support plate and a CCD camera and is configured to control the motion module in real time.

5 Claims, 2 Drawing Sheets

(51) Int. Cl.
*B01F 11/00* (2006.01)
*B01F 13/00* (2006.01)

(58) Field of Classification Search
CPC .. B01F 11/0283; B01F 3/182; B01F 7/00558; B01F 3/1242; B01F 11/0291; B01F 11/0097; B01F 13/0008
See application file for complete search history.

(56) References Cited

FOREIGN PATENT DOCUMENTS

| | | | | |
|---|---|---|---|---|
| CN | 206566846 | U | | 10/2017 |
| CN | 108252891 | A | | 7/2018 |
| CN | 208660990 | U | | 3/2019 |
| CN | 110193319 | A | | 9/2019 |
| FR | 1541739 | A | * | 10/1968 |
| JP | H09122611 | A | | 5/1997 |
| TW | 201536480 | A | | 10/2015 |
| WO | 2017204441 | A1 | | 11/2017 |

* cited by examiner

ANTI-AGGLOMERATION DEVICE USING ULTRASONIC WAVES FOR A NANOFLUID

CROSS-REFERENCE TO RELATED APPLICATIONS

This application is a continuation of International Patent Application No. PCT/CN2019/110845, filed on Oct. 12, 2019, which claims the benefit of priority from Chinese Patent Application No. 201910474925.2, filed on Jun. 3, 2019. The content of the aforementioned applications, including any intervening amendments thereto, is incorporated herein by reference in its entirety.

TECHNICAL FIELD

The present application relates to anti-agglomeration devices, and more particularly to an anti-agglomeration device for a nanofluid.

BACKGROUND

A nanofluid is a new kind of heat transfer medium which is uniform and stable and has high thermal conductivity. The nanofluid is usually prepared by dispersing metallic or non-metallic nanoparticles in the traditional liquid heat transfer media such as water and oil. The nanofluid has broad application prospects in the fields of energy, chemical industry, automobiles, architecture, microelectronics, information, etc., and thus has become research hotspots in many fields such as materials, physics, chemistry and heat transfer.

As the nanofluid has shown a significant enhancement of the heat transfer characteristic, it is gradually applied for lubrication and cooling in the machining. However, when the nanofluid is left standing for a long time, nanoparticles in the nanofluid are prone to form agglomeration, and then the sedimentation occurs, which directly affects the heat transfer and cooling efficiency of the nanofluid.

SUMMARY

In view of the problems in the prior art, the present application provides an anti-agglomeration device for a nanofluid, which can solve agglomeration of nanoparticles in the nanofluid, so as to improve the lubrication and cooling performance of the nanofluid in the machining. In the present application, gold nanoparticles generate ultrasonic waves under pulsed laser irradiation, and according to agglomeration area and degree in the nanofluid perceived by a photosensitive element, silica optical fibers and a liquid container are adaptively driven to the agglomeration area. The generated ultrasonic waves can disperse the agglomerated nanoparticles in the nanofluid, so as to effectively solve the agglomeration in the nanofluid.

The technical solutions of the present application are described as follows.

The present application provides an anti-agglomeration device for a nanofluid, comprising:

a support module;

a motion module;

a photoacoustic conversion module; and a control module;

wherein the support module comprises a frame and screws; the frame is configured to support the photoacoustic conversion module and the motion module;

the motion module comprises a servo motor, a dovetailed rail, a guide screw, a fixed plate, a slider and a deep groove ball bearing; the dovetailed rail is arranged on the frame via bolts; the guide screw is connected to the slider, and connected to the servo motor through the deep groove ball bearing; and the motion module consists of three groups of motion modules;

the photoacoustic conversion module comprises a nanosecond laser, a first clamp, a lens, a silica optical fiber, a second clamp, gold nanoparticles and a container; the nanosecond laser is fixed on the fixed plate; the first clamp is configured to hold the lens; the second clamp is configured to fix the silica optical fiber; the container is configured to store a nanogold solution formed from the gold nanoparticles; the container is fixed on a bottom of the silica optical fiber via bolts, and a fiber core of the silica optical fiber at its end is inserted into the nanogold solution; laser pulses generated by the nanosecond laser interacts with the gold nanoparticles in the container, and the gold nanoparticles periodically expand and shrink in volume under pulsed laser irradiation to generate ultrasonic waves; and the control module comprises a support plate, a charge-coupled device (CCD) camera and the nanofluid; the CCD camera is configured to monitor a suspension state of nanoparticles in the nanofluid; when agglomeration of the nanoparticles weakens a light signal acquired by a photosensitive element of the CCD camera, an instruction is issued to a computer control system to activate the motion module, so that the photoacoustic conversion module moves to an area where the nanoparticles agglomerate and sends the ultrasonic waves to disperse the agglomerated nanoparticles.

In some embodiments, the nanosecond laser has a wavelength of 527 nm, a pulse width of 150 ns, a repetition rate of 1 kHz, and a power of 120-130 mW; the silica optical fiber is a multimode optical fiber with a core diameter of 500-1000 μm; the gold nanoparticles have a particle size of 40-60 nm, and a concentration of the gold nanoparticles in the nanogold solution is 0.3-0.6 mg/mL; and the CCD camera has 5000×1 pixel sensor units.

In some embodiments, the frame, the dovetailed rail, the fixed plate and the slider each are made of steel.

In some embodiments, the second clamp is fixed on the slider.

In some embodiments, a position of the first clamp is adjustable to adapt different laser focusing requirements.

Compared to the prior art, the present application has the following beneficial effects.

1) In the present application, the dispersion performance of the nanofluid is significantly improved. The photoacoustic conversion module generates the ultrasonic waves based on the photoacoustic effect such that the nanofluid oscillates at a high frequency under the action of the ultrasonic waves, which can effectively reduce the agglomeration of nanoparticles in the nanofluid or disperse existing agglomerations, thereby significantly improving the dispersion performance of the nanofluid.

2) The anti-agglomeration device of the present application can accurately and directionally reduce the agglomeration of nanoparticles. Specifically, the photoacoustic conversion module is movable up, down, left, right, front and rear through the cooperation of the three groups of motion modules, so that the ultrasonic waves generated herein are directional to accurately and ultrasonically vibrate nanofluids in respective areas, thereby effectively reducing the agglomeration of nanoparticles.

3) The anti-agglomeration device of the present application can quickly solve the agglomeration of nanoparticles by closed-loop control. Specifically, the CCD camera monitors a suspension state of nanoparticles in the nanofluid in real time. When agglomeration of nanoparticles weakens a light signal acquired by a photosensitive element of the CCD camera, an instruction is issued to a computer control system to activate the motion module, so that the photoacoustic conversion module moves to an area where the agglomeration of nanoparticles occurs and sends the ultrasonic waves to disperse the agglomerated nanoparticles, thereby rapidly solving the agglomeration in the nanofluid.

4) The anti-agglomeration device of the present application has a simple structure and strong practicability. Specifically, the prepared nanogold solution can be used repeatedly, and it is easy and convenient to replace the container, the silica optical fiber. The anti-agglomeration device is suitable for anti-agglomeration of various nanofluids, displaying strong practicability.

Figure 1:
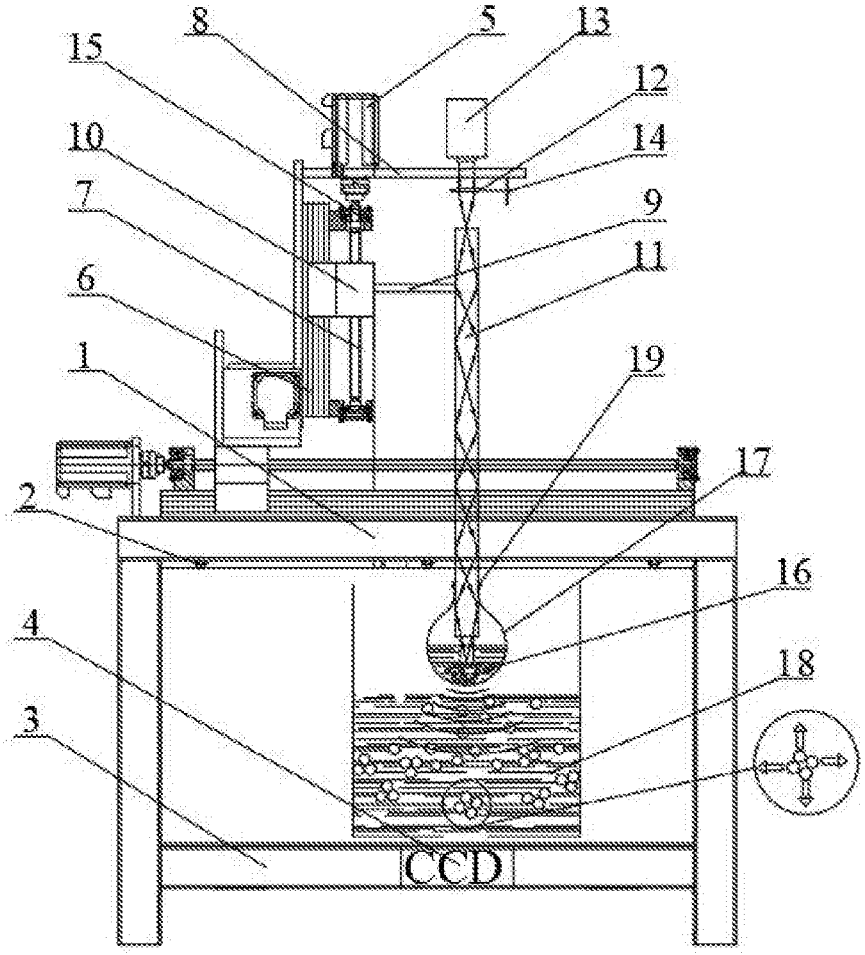
FIG. 1 is a schematic diagram of an anti-agglomeration device for a nanofluid in accordance with an embodiment of the present disclosure.
Figure 2:
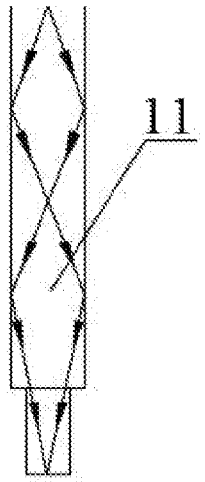
FIG. 2 schematically shows an optical path in a silica optical fiber of FIG. 1.
Figure 3:
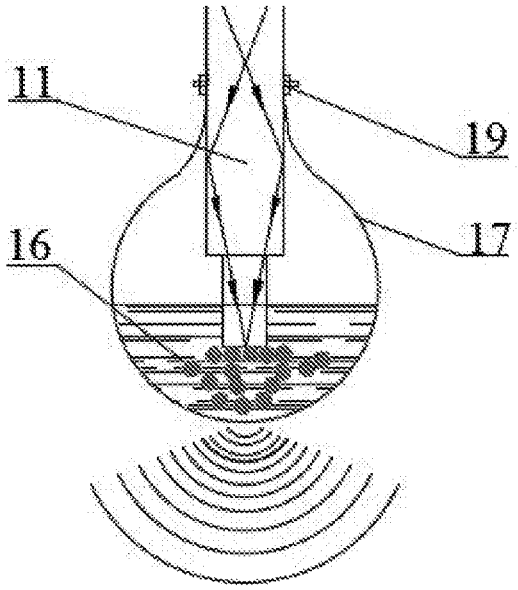
FIG. 3 illustrates a photoacoustic conversion of the anti-agglomeration device for the nanofluid in accordance with an embodiment of the present disclosure.

In the drawings, 1, frame; 2, screw; 3, support plate; 4, charge-coupled device (CCD) camera; 5, servo motor; 6, dovetailed rail; 7, guide screw; 8, fixed plate; 9, second clamp; 10, slider; 11, silica optical fiber; 12, lens; 13, nanosecond laser; 14, first clamp; 15, deep groove ball bearing; 16, gold nanoparticles; 17, container; 18, nanofluid; and 19, bolt.

DETAILED DESCRIPTION OF EMBODIMENTS

The technical solution of the present disclosure will be further described in detail below with reference to the accompanying drawings.

An anti-agglomeration device for a nanofluid includes a support module, a photoacoustic conversion module, a motion module and a control module. The support module includes a frame 1 and screws 2. The photoacoustic conversion module includes a nanosecond laser 13, a first clamp 14, a lens 12, a silica optical fiber 11, a second clamp 9, gold nanoparticles 16 and a container 17. The motion module includes a servo motor 5, a dovetailed rail 6, a guide screw 7, a fixed plate 8, a slider 10 and a deep groove ball bearing 15. The control module includes a support plate 3, a charge-coupled device (CCD) camera 4 and the nanofluid 18.

The frame 1 is configured to support the photoacoustic conversion module and the motion module.

The nanosecond laser 13 is fixed on the fixed plate 8. The first clamp 14 is configured to hold the lens 12. The second clamp 9 is configured to fix the silica optical fiber 11. A nanogold solution is formed from the gold nanoparticles 16, and is stored in the container 17. The container 17 is fixed on a bottom of the silica optical fiber 11 via bolts 19, and a fiber core of the silica optical fiber 11 at its end is inserted into the nanogold solution. Laser pulses generated by the nanosecond laser 13 interacts with the gold nanoparticles 16 in the container 17, and the gold nanoparticles 16 periodically expand and shrink in volume under pulsed laser irradiation to generate ultrasonic waves, so as to realize photoacoustic conversion. Under the action of the ultrasonic waves, the nanofluid oscillates at a high frequency, which can effectively reduce the agglomeration of nanoparticles in the nanofluid or disperse existing agglomerations, thereby significantly improving the dispersion performance of the nanofluid.

The dovetailed rail 6 is arranged on the frame 1 via bolts 19. The guide screw 7 is connected to the slider 10, and connected to the servo motor 5 via the deep groove ball bearing 15. The motion module consists of three groups of motion modules. The photoacoustic conversion module is movable up, down, left, right, front and rear through the cooperation of the three groups of motion modules, so as to ultrasonically vibrate the nanofluid 18 in respective areas, thereby preventing the agglomeration of nanoparticles.

The CCD camera 4 is configured to monitor a suspension state of nanoparticles in the nanofluid 18 in real time. When agglomeration of the nanoparticles weakens a light signal acquired by a photosensitive element of the CCD camera 4, an instruction is issued to a computer control system to activate the motion module, so that the photoacoustic conversion module moves to an area where the nanoparticles agglomerate and generates the ultrasonic waves to disperse the agglomerated nanoparticles.

The nanosecond laser 13 has a wavelength of 527 nm, a pulse width of 150 ns, a repetition rate of 1 kHz, and an average power of 120 mW. The silica optical fiber 11 is a multimode optical fiber with a core diameter of 1000 μm. The gold nanoparticles 16 have a particle size of 50 nm, and a concentration of the gold nanoparticles in the nanogold solution is 0.3 mg/mL. The CCD camera 4 is a charge-couple device with 5000×1 pixel sensor units. The frame 1, the dovetailed rail 6, the fixed plate 8 and the slider 10 each are made of steel. The second clamp 9 is fixed on the slider 10. A position of the first clamp 14 is adjustable to adapt different laser focusing requirements.

The above are only the preferred embodiments for the further illustration of the object, the technical solutions and the beneficial effects of the present disclosure, and are not intended to limit the scope of the present disclosure. Any changes, equivalent modifications and improvements based on the concept of the present disclosure shall fall within the scope of the present disclosure.

What is claimed is:

1. An anti-agglomeration device for a nanofluid, comprising:

a support module;

a motion module;

a photoacoustic conversion module; and a control module;

wherein the support module comprises a frame and screws; the frame is configured to support the photoacoustic conversion module and the motion module;

the motion module comprises a servo motor, a dovetailed rail, a guide screw, a fixed plate, a slider and a deep groove ball bearing; the dovetailed rail is arranged on the frame via bolts; the guide screw is connected to the slider, and connected to the servo motor through the deep groove ball bearing; and the motion module consists of three groups of motion modules;

the photoacoustic conversion module comprises a nanosecond laser, a first clamp, a lens, a silica optical fiber, a second clamp, gold nanoparticles and a container; the nanosecond laser is fixed on the fixed plate; the first clamp is configured to hold the lens; the second clamp is configured to fix the silica optical fiber; the container is configured to store a nanogold solution formed from the gold nanoparticles; the container is fixed on a bottom of the silica optical fiber via bolts, and a fiber core of the silica optical fiber at its end is inserted into the nanogold solution; laser pulses generated by the nanosecond laser interacts with the gold nanoparticles in the container, and the gold nanoparticles periodically expand and shrink in volume under pulsed laser irradiation to generate ultrasonic waves; and the control module comprises a support plate, a charge-coupled device (CCD) camera and the nanofluid; the CCD camera is configured to monitor a suspension state of nanoparticles in the nanofluid; when agglomeration of the nanoparticles weakens a light signal acquired by a photosensitive element of the CCD camera, an instruction is issued to a computer control system to activate the motion module, so that the photoacoustic conversion module moves to an area where the agglomeration occurs and sends the ultrasonic waves to disperse the agglomerated nanoparticles.

2. The anti-agglomeration device of claim 1, wherein the nanosecond laser has a wavelength of 527 nm, a pulse width of 150 ns, a repetition rate of 1 kHz, and a power of 120-130 mW; the silica optical fiber is a multimode optical fiber with a core diameter of 500-1000 μm; the gold nanoparticles have a particle size of 40-60 nm, and a concentration of the gold nanoparticles in the nanogold solution is 0.3-0.6 mg/mL; and the CCD camera has 5000×1 pixel sensor units.

3. The anti-agglomeration device of claim 1, wherein the frame, the dovetailed rail, the fixed plate and the slider each are made of steel.

4. The anti-agglomeration device of claim 1, wherein the second clamp is fixed on the slider.

5. The anti-agglomeration device of claim 1, wherein a position of the first clamp is adjustable.

* * * * *